US011330946B2

(12) United States Patent
Chang

(10) Patent No.: US 11,330,946 B2
(45) Date of Patent: May 17, 2022

(54) DUST COLLECTOR

(71) Applicant: Chia-Chuan Chang, Yilan (TW)

(72) Inventor: Chia-Chuan Chang, Yilan (TW)

( * ) Notice: Subject to any disclaimer, the term of this patent is extended or adjusted under 35 U.S.C. 154(b) by 298 days.

(21) Appl. No.: 16/594,074

(22) Filed: Oct. 7, 2019

(65) Prior Publication Data

US 2021/0100414 A1 Apr. 8, 2021

(51) Int. Cl.
*A47L 9/10* (2006.01)

(52) U.S. Cl.
CPC ..... *A47L 9/106* (2013.01)

(58) Field of Classification Search
CPC .... A47L 9/1633; A47L 9/1658; A47L 9/1608; A47L 9/1616; A47L 9/1625; A47L 9/1666; A47L 9/1418; A47L 9/1427; A47L 9/106; A47L 9/122; A47L 9/1683; B01D 45/08; B01D 45/16; B01D 46/0039; B01D 46/0041; B01D 46/0042; B01D 46/0043; B01D 46/0045; B01D 46/0046
USPC ..... 15/347, 353; 55/341.1–341.6, 399, 407, 55/413, 462–465
See application file for complete search history.

(56) References Cited

U.S. PATENT DOCUMENTS

2012/0167336 A1* 7/2012 Tran ..... A47L 9/122 15/347
2014/0093301 A1* 4/2014 Cho ..... A47L 9/1427 403/24
2020/0008636 A1* 1/2020 Lee ..... A47L 9/1683

* cited by examiner

*Primary Examiner* — Joseph J Hail
*Assistant Examiner* — Timothy Brady
(74) *Attorney, Agent, or Firm* — Leong C. Lei

(57) ABSTRACT

A dust collector comprises: a first container, a vacuum motor, a first-flow guiding unit, and a second flow-guiding unit; wherein the first container is set with a first tube-body, and the vacuum motor is set on a cover-body; wherein the motor is set with a filter, wherein the first flow-guiding unit and the second flow-guiding unit are respectively detachably combined with a second container and a third container; wherein the second flow-guiding unit is located in the first flow-guiding unit, and the first tube-body sucks in air, so that the dust and debris in the air enter the first container; wherein the air sequentially passes through the first flow-guiding unit and the second flow-guiding unit to form a vortex to make the fine dust fell into the second container and the third container; and the air is finally discharged by the vacuum motor after passes through the filter.

3 Claims, 6 Drawing Sheets

DUST COLLECTOR

(a) TECHNICAL FIELD OF THE INVENTION

The present invention relates to a dust collector for use in decorating or woodworking, and especially relates to a dust collector for dust sucking and dust collecting, which has multi-channels for separating the retaining dust or foreign matter, and has a function of filtering air.

(b) DESCRIPTION OF THE PRIOR ART

A vacuum cleaner is configured to use suction to introduce air and filter and collect foreign matter, dust, and fine dust contained in the air, and the type of the vacuum cleaner can be classified into (i) a lying type; (ii) a stand type (upright type); (iii) a hand-held type; and (iv) a cylindrical floor type or the like.

The lying type vacuum cleaner is the most commonly used vacuum cleaner in the home in recent years, and has a structure in which the suction unit and the cleaner main-body are separated from each other.

Usually, the lying type vacuum cleaner does not set with a rotating brush, which is suitable for cleaning the floor because it only sucks the air is by the suction unit when cleaning.

In contrast, an upright vacuum cleaner is a vacuum cleaner having a structure in which a suction unit is integrated into the main-body of the cleaner.

Generally, an upright vacuum cleaner can be set with a rotating brush, and therefore, unlike the lying type vacuum cleaner, it has the advantage of being able to clean the dust in a carpet.

However, conventional vacuum cleaners have the following disadvantages:

Firstly, the structure of a vacuum cleaner as disclosed in Korean Patent Publication No. 10-2003-0081443 (published on Oct. 17, 2003) has a multi-stage cyclone separator structure; each of which is vertically set to cause the problem of increasing the height of the dust collector.

In addition, the dust collector is designed to have a slim profile to solve such a problem of increased volume, thus resulting in a disadvantage of reducing the actual space volume in which the dust is collected.

In order to solve the aforementioned problems, a structure in which a second cyclone separator is set in a first cyclone separator is proposed, as disclosed in the Korean Patent Publication No. 10-2004-0023417 (published on Mar. 18, 2004).

However, it is difficult to effectively set the second cyclone separator in the first cyclone separator due to the interference between the guiding passages set in each of the second cyclone separators.

Even if the second cyclone separator is set in the first cyclone separator, the number of the second cyclone separators is greatly reduced to reduce the suction force, resulting in a decrease in cleaning performance.

Further, various flows including the high-speed swirling flow generated by the suction force of the fan unit are mixed in a dust collector. Such kind of complex flows may hinder the introduction of foreign matter and dust into the first storage area, and may cause the dust collected in the first storage area to rise and flow back to the upstream direction.

According to the structure disclosed in Korean Patent Publication No. 10-2004-0023417 (published on Mar. 18, 2004), a side-skirt can also be set inside to avoid the foreign matter and dust stored in the first storage area located below the first cyclone separator from being scattered. Since the portion where the side-skirt is formed may form a small gap with the outer casing, a phenomenon in which foreign matter is caught in the gap may occur. When the foreign matter is caught in the gap, other foreign matter and dust cannot flow into the first storage area through the gap.

Furthermore, when the foreign matter and dust collected in the first storage area are piled up to slowly approach the first cyclone separator side; even when they are collected in the first storage area, especially when they are the bulky foreign matter, they will have no aggregated shape, but are dispersed in the first storage area; thereby causing the piled up dust flow back to the upstream direction.

On the other hand, most of the foreign matter or dust that has not passed through the first cyclone separator is collected in the first storage area; but in some cases, the foreign matter or dust may be caught or accumulated and fixed in a screen filter; which will reduce the area of the air passing through the screen filter, thereby increasing the load on the fan unit that provides the suction force and giving the user an impression of being visually unclean.

SUMMARY OF THE INVENTION

In view of the above-mentioned disadvantages, the dust collector of the present invention comprises: a first container, a vacuum motor, a first-flow guiding unit and a second flow-guiding unit, wherein the first container is set with a first tube-body, and the vacuum motor is set on a cover-body; wherein the motor is set with a filter, and the first flow-guiding unit is set on the bottom surface of the cover-body and combined with the second flow-guiding unit; wherein the first flow-guiding unit and the second flow-guiding unit are respectively detachably combined with a second container and a third container; wherein the second flow-guiding unit is located in the first flow-guiding unit, and the first tube-body sucks in air, so that the dust and debris in the air enter the first container; wherein the air sequentially passes through the first flow-guiding unit and the second flow-guiding unit to form a vortex to make the fine dust fell into the second container and the third container; and the air is finally discharged by the vacuum motor after passes through the filter.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Figure 1:
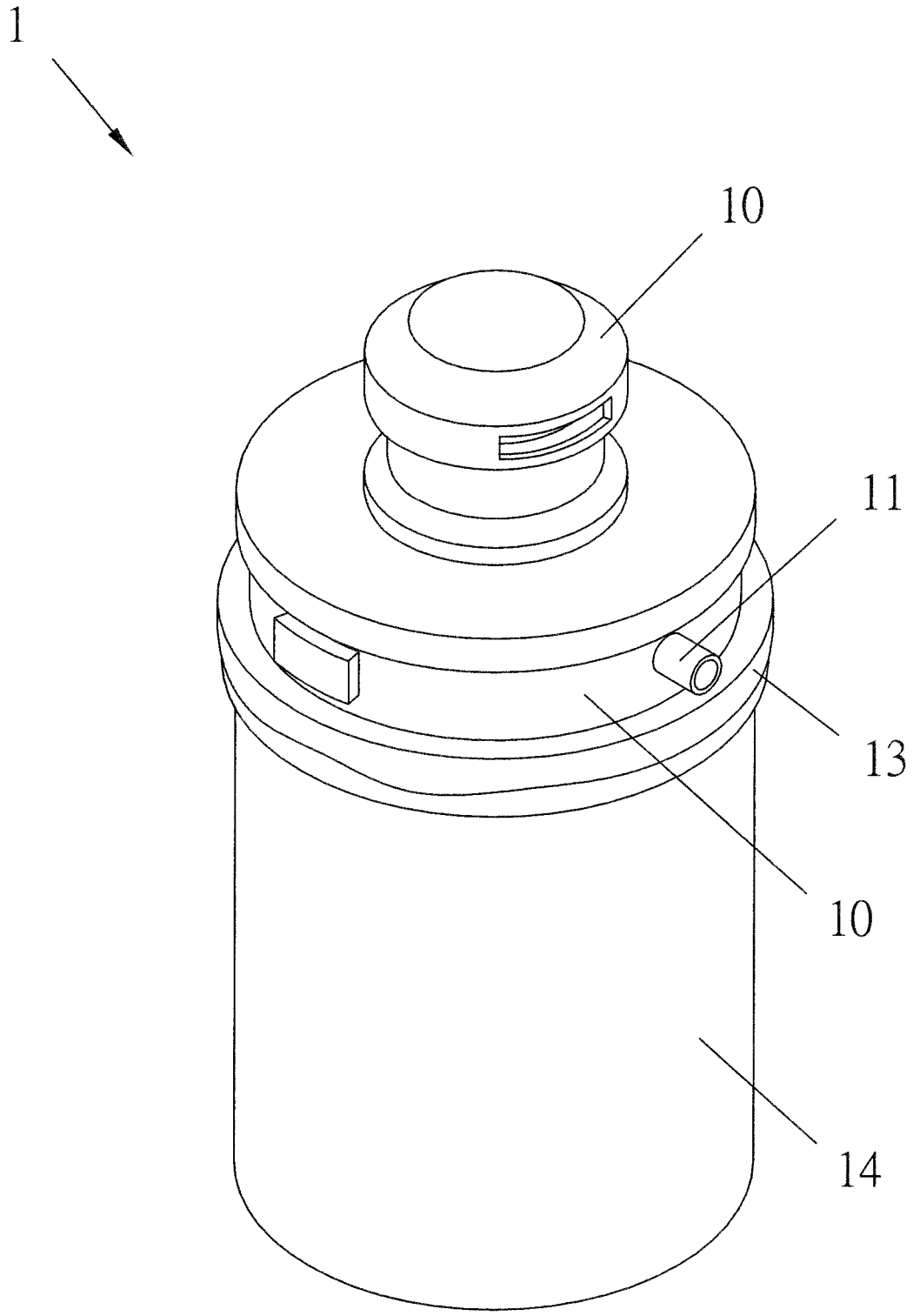
FIG. 1 is a stereoscopic appearance diagram of the present invention.
Figure 2:
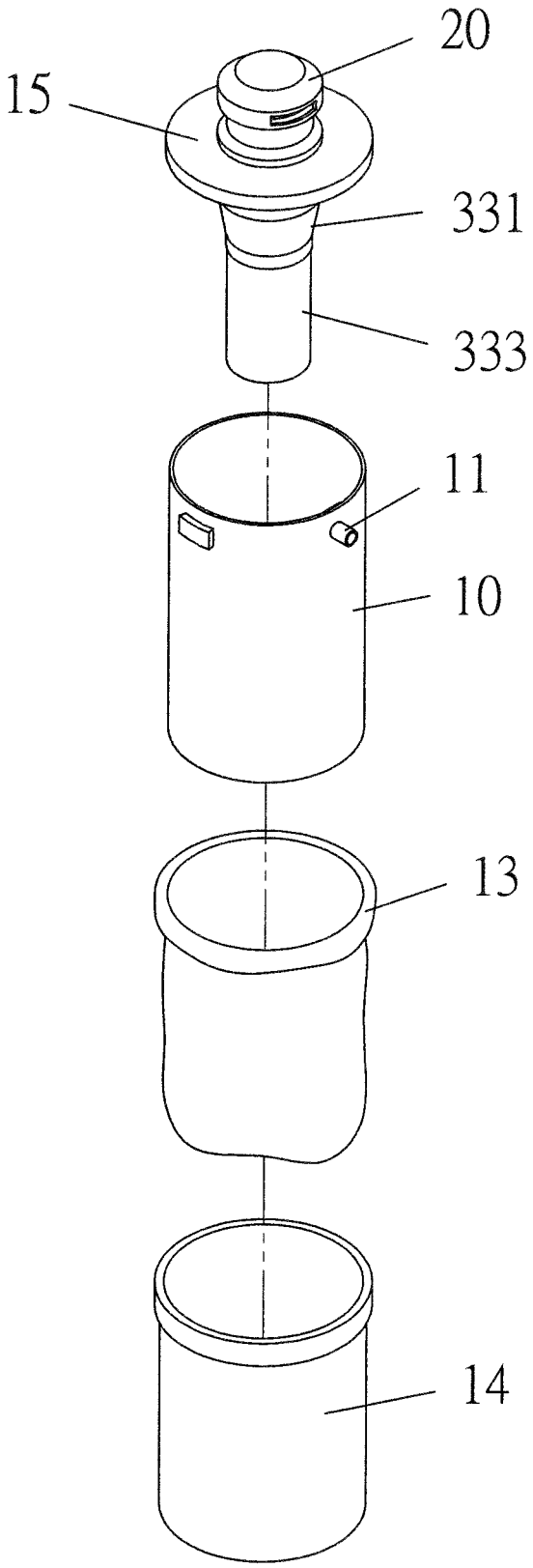
FIG. 2 is a stereoscopic exploded view of the present invention.
Figure 3:
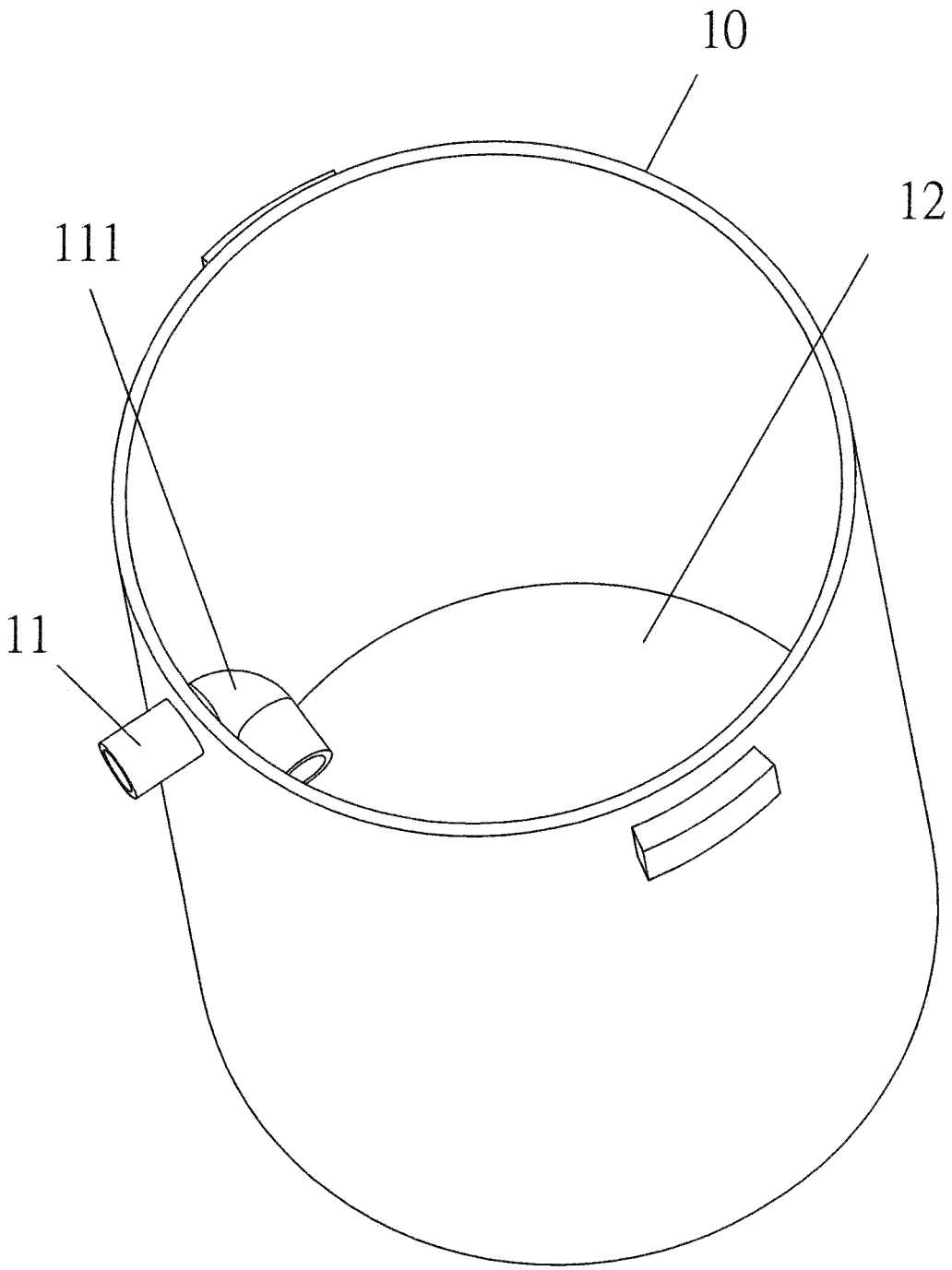
FIG. 3 is a stereoscopic appearance diagram of the first container of the present invention.
Figure 4:
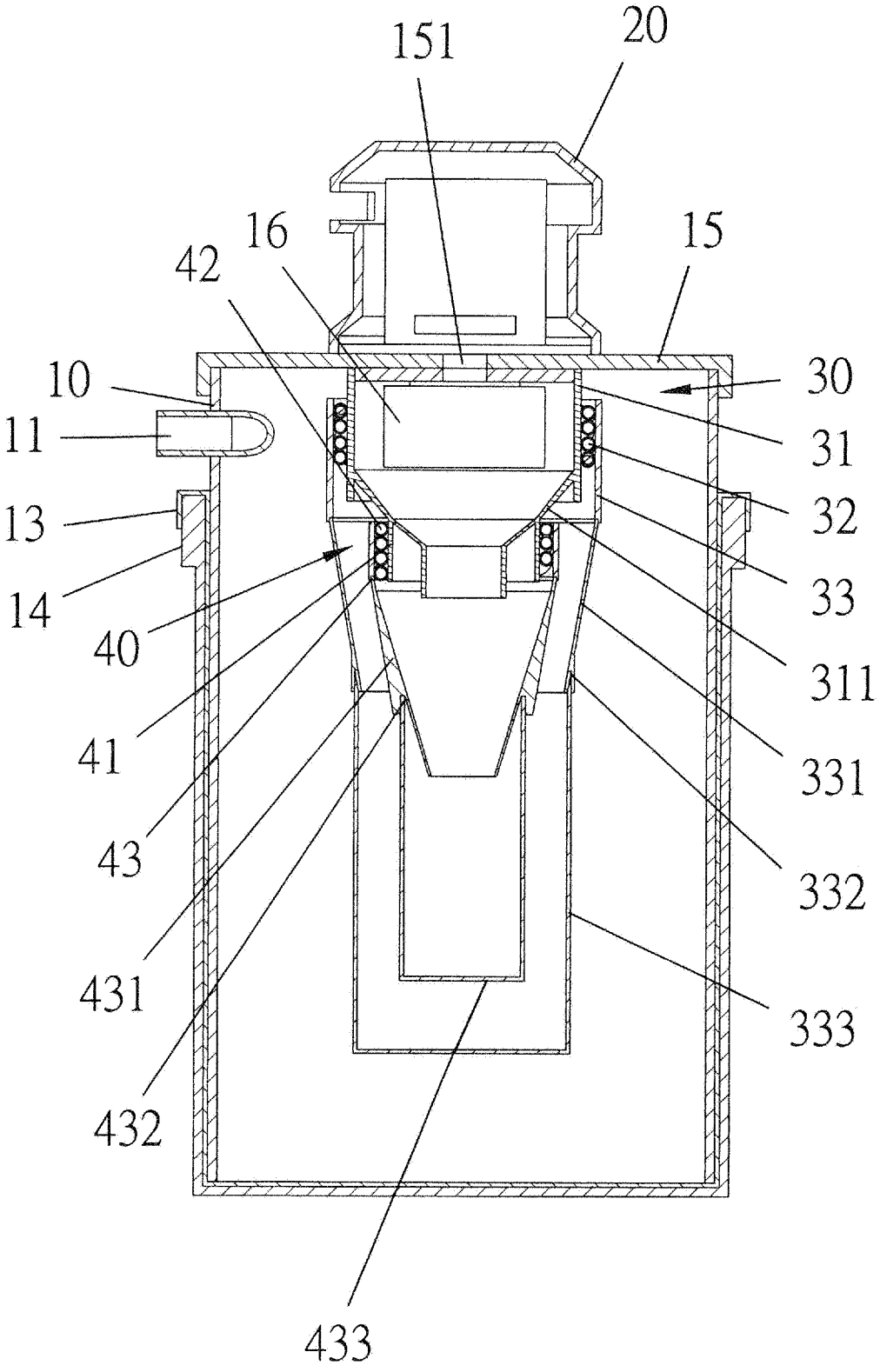
FIG. 4 is a cross-sectional view of the using state of the present invention.
Figure 5:
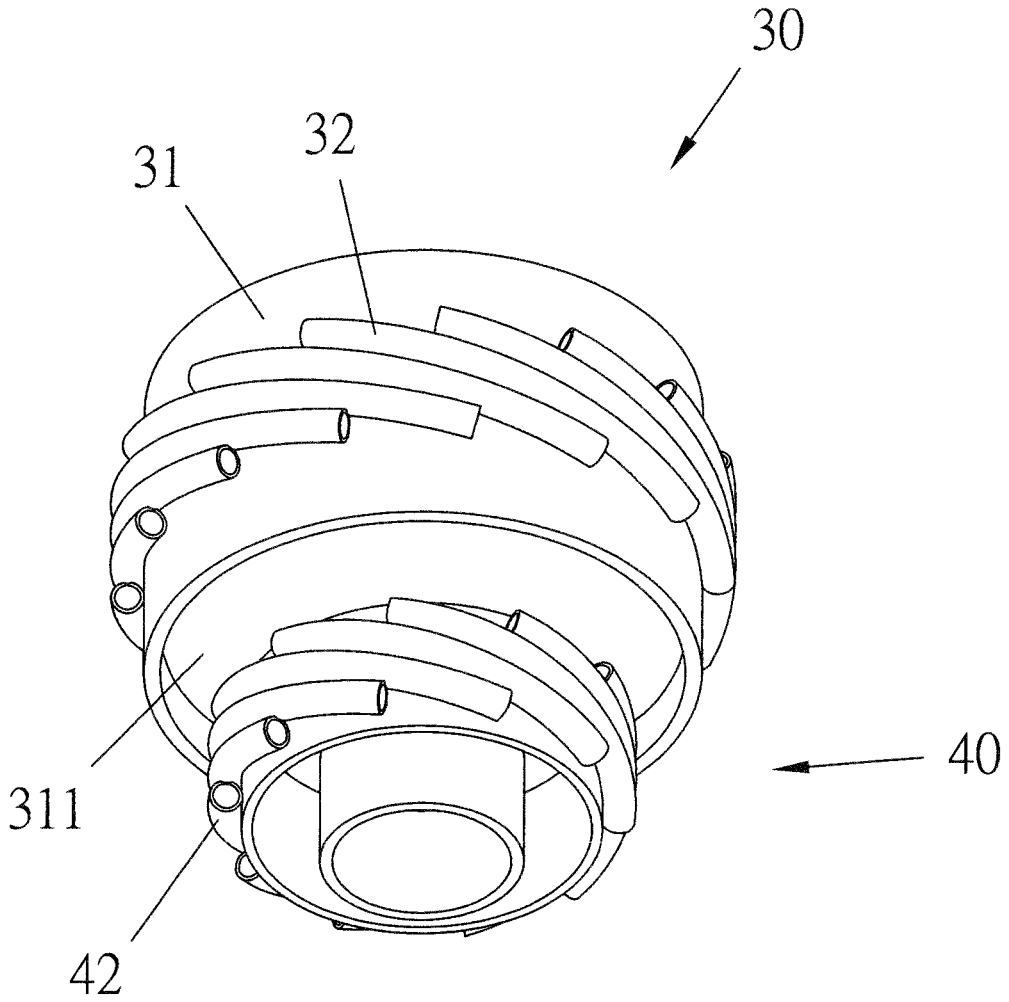
FIG. 5 is an internal stereoscopic diagram of the first flow-guiding unit and the second flow-guiding unit of the present invention.

Please refer to FIG. 1 and FIG. 2, the dust collector 1 of the present invention comprises: a first container 10 set with a first tube-body 11, and two ends of the first tube-body 11 are respectively located on the outer side and the inner side of the first container 10; wherein one end in the inner side of the first container 10 has a bent portion 111 that faces toward the first container 10, thereby forming a vortex when air enters; please refer to FIG. 2 and FIG. 4, in this embodiment, the bottom of the first container 10 has a through-hole 12, and the first container 10 is accommodated and set in a fourth container 14 sleeved and set with a bag-body 13; a vacuum motor 20 including an air inlet (not shown in the figure), wherein the vacuum motor 20 is set on a top surface of a cover-body 15, and the cover-body 15 is set with a through-hole 151 corresponding to the air inlet; wherein the through-hole 151 is detachably combined with a filter 16 and is located on the bottom surface of the cover-body 15; a first flow-guiding unit 30 comprising a first inner-tube 31, a plurality of first flow-guiding tubes 32, and a first outer-tube 33; wherein the first inner-tube 31 has a first convergent-portion 311, and one end of the first inner-tube 31 is combined with the bottom surface of the cover-body 15; such that the filter 16 is located in the first inner-tube 31; wherein the diameter of one end of the first inner-tube 31 combined with the cover-body 15 is larger than the other end; please refer to FIG. 4 and FIG. 5, each of the first flow-guiding tubes 32 is obliquely distributed and set on the outer side of the first inner-tube 31; wherein the first outer-tube 33 is combined on the outer side of each of the first flow-guiding tubes 32, and the length of the first outer-tube 33 is greater than the length of the first inner-tube 31; wherein the first outer-tube 33 has a second convergent-portion 331, and the bottom of the second convergent-portion 331 is set with a first sticking-engaging slot 332 for providing to detachably combine with a second container 333; a second flow-guiding unit 40 comprising a second inner-tube 41, a plurality of second flow-guiding tubes 42, and a second outer-tube 43; wherein the second inner-tube 41 is combined on the outer side of the first inner-tube 31 and is located inside the first outer-tube 33; wherein each of the second flow-guiding tubes 42 is obliquely distributed and set on the outer side of the second inner-tube 41, and the second outer-tube 43 is combined on the outer side of each of the second flow-guiding tubes 42, wherein the length of the second outer-tube 43 is greater than the length of the second inner-tube 41; wherein the second outer-tube 43 has a third convergent-portion 431, and the bottom of the third convergent-portion 431 is set with a second sticking-engaging slot 432 for providing to detachably combine with a third container 433.

After the vacuum motor 20 of the dust collector 1 of the present invention is started, air enters the first container 10 from the first tube-body 11; and the dust or debris foreign matter will be retained in the first container 10 initially; then the air in the first container 10 will enter along each of the first flow-guiding tubes 32 to further retain the dust of the air in the second container 333; at the same time, the air enters the third container 433 along the second flow-guiding tubes 42 from the first flow-guiding unit 30; and the dust and the fine dust of the air are again retained in the third container 433; then, the air is discharged through the filter 16, and the filter 16 can capture finer dust of the air, making the discharged air harmless to the human body.

In short, the dust collector 1 of the present invention has three containers for retaining the dust or debris foreign matter, which can purify the air by the filter 16 and simultaneously have functions of sucking dust, collecting dust, and purifying the air.

Figure 6:
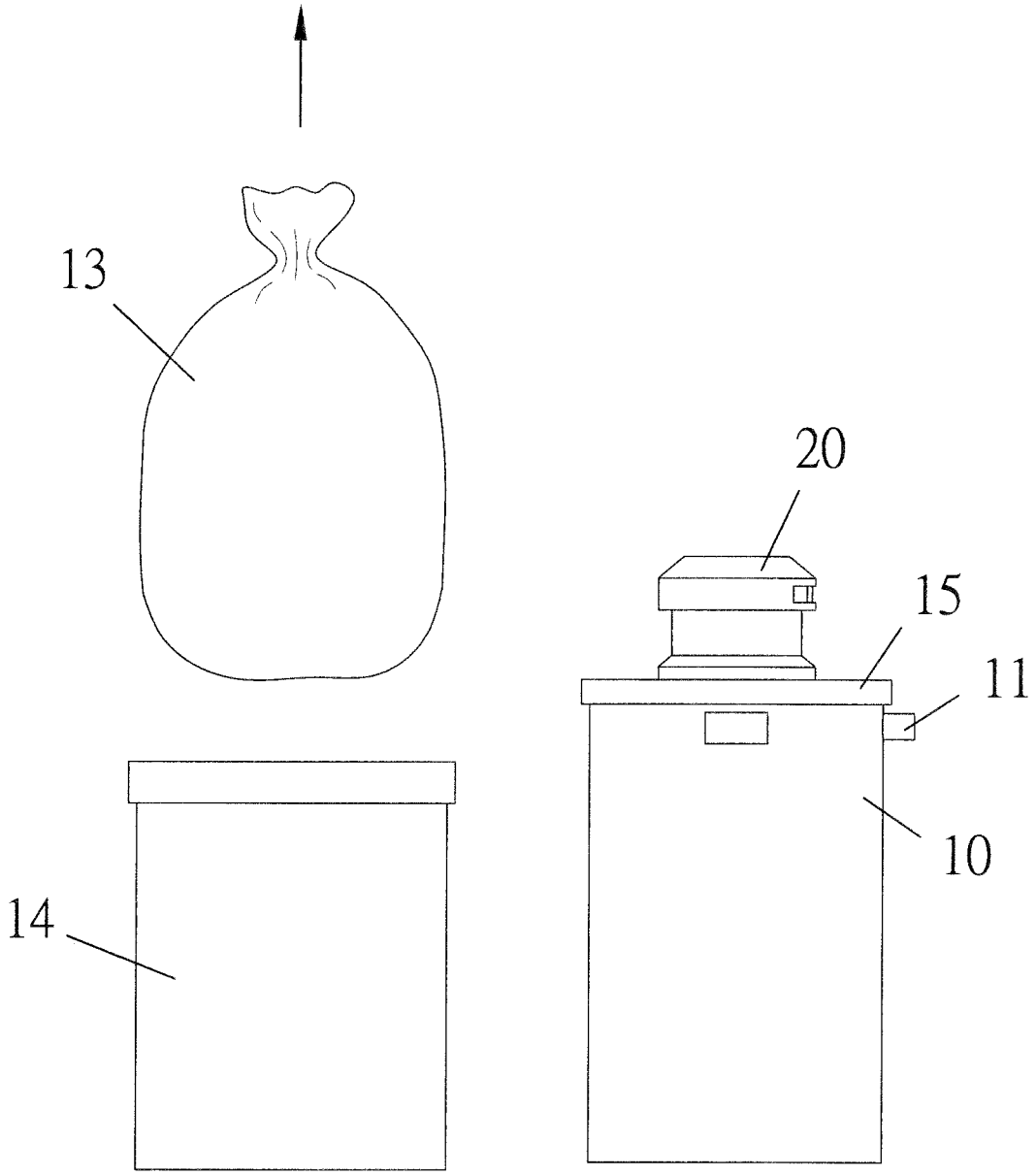
FIG. 6 is a schematic diagram of the cleaning state of the present invention.

Please refer to FIG. 6, after the dust collector 1 of the present invention is used, the first container 10 can be taken out; since the first container 10 and the fourth container 14 are set with the bag-bodies 13, dust and debris will fall into the bag-bodies 13; and the bag-bodies 13 can be quickly packed to be conveniently cleaned.

Moreover, the first container 10 can also be not set with the through-hole 12, so that the dust and debris will fall inside the first container 10, so the dust and debris can be separately poured into the garbage bag for cleaning.

I claim:

1. A dust collector, which comprises:

a vacuum motor comprising an air inlet, wherein the vacuum motor is set on a top surface of a cover-body, and the cover-body is set with a through-hole corresponding to the air inlet; wherein the through-hole is detachably combined with a filter and is located on a bottom surface of the cover-body;

a first flow-guiding unit comprising a first inner-tube, a plurality of first flow-guiding tubes, and a first outer-tube; wherein the first inner-tube has a first convergent-portion, and one end of the first inner-tube is combined with the bottom surface of the cover-body; such that the filter is located in the first inner-tube; wherein the diameter of one end of the first inner-tube combined with the cover-body is larger than the other end;

wherein each of the first flow-guiding tubes is obliquely distributed and set on an outer side of the first inner-tube;

wherein the first outer-tube is combined on the outer side of each of the first flow-guiding tubes, and the length of the first outer-tube is greater than the length of the first inner-tube;

wherein the bottom end of the first outer-tube is detachably combined with a second container; and a second flow-guiding unit comprising a second inner-tube, a plurality of second flow-guiding tubes, and a second outer-tube; wherein the second inner-tube is combined on the outer side of the first inner-tube and is located inside the first outer-tube;

wherein each of the second flow-guiding tubes is obliquely distributed and set on an outer side of the second inner-tube, and the second outer-tube is combined on the outer side of each of the second flow-guiding tubes, wherein the length of the second outer-tube is greater than the length of the second inner-tube.

2. The dust collector according to claim 1, wherein the first outer-tube has a second convergent-portion, and a bottom of the second convergent-portion is set with a first sticking-engaging slot for providing to detachably combine with the second container; wherein the second outer-tube has a third convergent-portion, and a bottom of the third convergent-portion is set with a second sticking-engaging slot for providing to detachably combine with a third container.

3. The dust collector according to claim 1, wherein a bottom of the first container has a through-hole, and the first container is accommodated and set in a fourth container sleeved and set with a bag-body.

* * * * *